US006572445B2

(12) United States Patent
Laursen

(10) Patent No.: US 6,572,445 B2
(45) Date of Patent: Jun. 3, 2003

(54) MULTIZONE SLURRY DELIVERY FOR CHEMICAL MECHANICAL POLISHING TOOL

(75) Inventor: Thomas Laursen, Phoenix, AZ (US)

(73) Assignee: Speedfam-IPEC, Chandler, AZ (US)

( * ) Notice: Subject to any disclaimer, the term of this patent is extended or adjusted under 35 U.S.C. 154(b) by 80 days.

(21) Appl. No.: 09/863,582

(22) Filed: May 16, 2001

(65) Prior Publication Data

US 2002/0173232 A1 Nov. 21, 2002

(51) Int. Cl.[7] ..... B24B 49/00

(52) U.S. Cl. ..... 451/10; 451/11; 451/41; 451/60; 451/285; 451/287; 451/446

(58) Field of Search ..... 451/8, 9, 10, 11, 451/41, 60, 285, 287, 288, 446

(56) References Cited

U.S. PATENT DOCUMENTS 4,593,716 A 6/1986 Cesna
5,533,923 A * 7/1996 Shamouilian et al. ..... 451/41
5,816,900 A * 10/1998 Nagahara et al. ..... 451/285
5,857,893 A 1/1999 Olsen et al.
5,872,633 A 2/1999 Holzapfel et al.
5,921,849 A 7/1999 Kim et al.
6,280,297 B1 * 8/2001 Tolles et al. ..... 451/41
6,306,009 B1 * 10/2001 Sandhu et al. ..... 451/7
6,368,194 B1 * 4/2002 Sharples et al. ..... 451/67
6,375,544 B1 * 4/2002 Brunelli ..... 451/36

* cited by examiner

*Primary Examiner*—Eileen P. Morgan
(74) *Attorney, Agent, or Firm*—Ingrassia Fisher & Lorenz, PC

(57) ABSTRACT

The present invention includes a platen having a plurality of concentric fluid-tight plenums for receiving fluids. One or more fluid delivery systems may be used to control the flow rate and composition of fluids communicated to the plenums. The top surface of the platen may have holes for allowing the fluids, once inside the plenums, to travel to the top surface of a polishing pad. By controlling the flow rate and composition of fluids, the material removal rate on the front surface of the wafer may also be controlled. The polishing pad is preferably orbited during the planarization process. A metrology instrument may be used for measuring the front surface of the wafer. Data regarding the measurements may be used by a computer to determine if different flow rates and/or composition of fluids should be used to compensate for nonuniform polishing of the wafer.

16 Claims, 4 Drawing Sheets

MULTIZONE SLURRY DELIVERY FOR CHEMICAL MECHANICAL POLISHING TOOL

TECHNICAL FIELD

The invention relates to semiconductor manufacturing and more specifically to a method and apparatus for controlling the delivery of slurry through a polishing pad on a chemical mechanical polishing (CMP) tool.

BACKGROUND OF THE INVENTION

A flat disk or "wafer" of single crystal silicon is the basic substrate material in the semiconductor industry for the manufacture of integrated circuits. Semiconductor wafers are typically created by growing an elongated cylinder or boule of single crystal silicon and then slicing individual wafers from the cylinder. The slicing causes both faces of the wafer to be extremely rough. The front face of the wafer on which integrated circuitry is to be constructed must be extremely flat in order to facilitate reliable semiconductor junctions with subsequent layers of material applied to the wafer. Also, the material layers (deposited thin film layers usually made of metals for conductors or oxides for insulators) applied to the wafer while building interconnects for the integrated circuitry must also be made a uniform thickness.

Planarization is the process of removing projections and other imperfections to create a flat planar surface, both locally and globally, and/or the removal of material to create a uniform thickness for a deposited thin film layer on a wafer. Semiconductor wafers are planarized or polished to achieve a smooth, flat finish before performing process steps that create the integrated circuitry or interconnects on the wafer. A considerable amount of effort in the manufacturing of modern complex, high density multilevel interconnects is devoted to the planarization of the individual layers of the interconnect structure. Nonplanar surfaces create poor optical resolution of subsequent photolithography processing steps. Poor optical resolution prohibits the printing of high-density lines. Another problem with nonplanar surface topography is the step coverage of subsequent metalization layers. If a step height is too large there is a serious danger that open circuits will be created. Planar interconnect surface layers are required in the fabrication of modem high-density integrated circuits. To this end, chemical-mechanical polishing (CMP) tools have been developed to provide controlled planarization of both structured and unstructured wafers.

CMP consists of a chemical process and a mechanical process acting together, for example, to reduce height variations across a dielectric region, clear metal deposits in damascene processes or remove excess oxide in shallow trench isolation fabrication. The chemical-mechanical process is achieved with a liquid medium containing chemicals and possibly abrasive particles (commonly referred to as slurry) that react with the front surface of the wafer while it is mechanically stressed during the planarization process.

In a conventional CMP tool for planarizing a wafer, a wafer is secured in a carrier connected to a shaft. Pressure is exerted on the back surface of the wafer by the carrier in order to press the front surface of the wafer against the polishing pad in the presence of slurry. The wafer and/or polishing pad are then moved in relation to each other via motor(s) connected to the shaft and/or platen in order to remove material in a planar manner from the front surface of the wafer. Various combinations of motions are known for moving the wafer and polishing pad in relation to each other. For example, the wafer is commonly rotated or held stationary and the polishing pad is moved in either a linear, rotational or orbital manner.

A common problem in CMP is for the wafer to polish in a nonplanar manner. The wafer typically has a "bull's-eye" pattern with the center of the wafer being polishing either faster or slower than the circumference. The polishing rate tends to be uniform within concentric bands, but not across the entire surface of the wafer. Numerous attempts have been made to remedy this problem with only partial success. This problem has recently worsened as some of the slurries used to planarize wafers with copper thin films result in nonuniform material removal with limited process control.

One attempted solution for the situation where the center of the wafer is being polished too slowly is to move the edge of the wafer over the edge of the polishing pad. This will slow the removal rate of material at the edge of the wafer to approximate the removal rate at the center of the wafer. This solution is relatively inexpensive, but has several problems. One problem is that this solution is not able to compensate for the center fast situation. In addition, front-reference carriers (those supporting the wafer by air or a membrane) tend to break or lose control of the wafer when the wafer is placed over the edge of the polishing pad. Another problem is that this approach has minimal flexibility in fine tuning the removal rate over the entire surface of the wafer.

Another attempted solution is to use a multizone carrier. Multizone carriers typically have a central zone and one or more concentric zones for altering the polishing rate for corresponding concentric zones on the wafer. Each of the zones in the carrier may be configured to apply an individually controllable pressure on the back surface of the wafer. In this way, concentric bands that are polishing too quickly or too slowly on the front surface of the wafer may receive a correcting lower or higher pressure on the back surface of the wafer by the multizone carrier. This approach adds more flexibility to the process, but also adds a great deal of expense and complexity to the process.

What is needed is a method and apparatus for uniformly planarizing a wafer that avoids the problems of the prior art. The solution needs to provide flexibility to the planarization process to correct for nonuniform polishing, while remaining simple and cost-effective.

SUMMARY OF THE INVENTION

The present invention improves the planarization process of a wafer during a chemical mechanical polishing process while avoiding the problems of the prior art. An object of the invention is to provide a method and apparatus that may be used to alter the removal rate of material from the front surface of the wafer to compensate for nonuniform polishing. Another object of the invention is to provide an apparatus and method for controlling the distribution of slurry to the top surface of the polishing pad.

The apparatus includes a platen having a bottom surface, a top surface and a plurality of circular walls (having different radial dimensions) extending from the bottom surface to the top surface. The bottom surface, top surface and circular walls define a plurality of concentric plenums within the platen. The bottom surface, top surface and circular walls may be manufactured as one, two or three separate pieces and may be made from the same or different materials. The bottom surface has a plurality of holes that a plurality of fluid delivery systems delivers fluids through to each plenum. The holes may be along a single diameter of the bottom surface or may be spaced apart to simplify the manufacturing process. The top surface also has holes for allowing the fluids, once inside the plenums, to travel through to reach the polishing pad. The holes in the top surface may be strategically placed to enhance the distribution of slurry on the top surface of the polishing pad.

The circular walls may be an integral part of the bottom or top surface of the platen or may be a separate component. The circular walls preferably provide fluid tight separators between the plenums and may be an o-ring. If o-rings are used, grooves are preferably created in the bottom and/or top surface of the platen to accept the o-rings.

A polishing pad may be supported on the top surface of the platen. The polishing pad may include a plurality of holes that align with the holes in the top surface of the platen to facilitate fluid flowing from the plenums through the top surface of the platen and through the polishing pad.

A metrology instrument may also be used, preferably having at least one probe near each plenum, for measuring a front surface of the wafer. Fewer probes may be used to simplify and reduce the cost of the metrology instrument or additional probes may be used to enhance the capabilities of the metrology instrument. The metrology instrument may be, for example, a multiprobe end-point detection system. Data regarding the measurements may be used by a computer to determine if corrections to the planarization process may advantageously be made.

Each fluid delivery system may include a tank, pump, valve and computer. The tank stores the slurry and may be used with other fluid delivery systems and/or other CMP tools. The pump communicates the fluids from the tank to the plenums and includes traditional pumps or gravity delivery systems. Valves may be used to regulate the flow of fluids from the tank to the plenums. A computer (network, stand alone, etc.) may be used to automate the entire CMP tool and control the functions of the pump and/or valves. The fluids used may be mixed in the tank. This will simplify the number of fluid delivery systems needed. However, the preferred method is to have a separate fluid delivery system for each fluid and to mix the fluids as close to the point of use as possible. This keeps the fluids from undesirably interacting with each other prior to use.

The preferred motion for the polishing pad is an orbital motion created by an orbital motion generator connected to the bottom surface of the platen. However, one skilled in the art will recognize that the invention may be used with other motion platforms such as a rotational or linear with only minor modifications to the embodiments specifically illustrated. A small radius for an orbital motion of the polishing pad may be used to effectively planarize a wafer. The small radius for the orbital motion allows the center, middle and periphery of the polishing pad to stay near the corresponding center, middle and periphery of the wafer during the planarization process. This fact simplifies the process of determining the effects of different flow rates and composition of fluids distributions across the surface of the polishing pad.

In practice, a desired flow rate and composition of fluids may be communicated from the tanks to the top surface of the polishing pad via the fluid delivery systems as previously discussed. By utilizing a plurality of fluid delivery systems in fluid communication with different concentric plenums, a different flow rate and/or composition of fluids may be delivered to different concentric portions on the top surface of the polishing pad.

The polishing pad is moved in relation to the front surface of the wafer, preferably orbited, as the wafer is pressed against the polishing pad to planarize the wafer. The planarization process may be monitored and the wafer measured by a metrology instrument that preferably has at least one probe that corresponds to the location of each plenum. Fewer probes than the number of plenums may be used to simplify and lower the cost of the metrology instrument. A change in the flow rate and/or composition of fluids from one or more of the plurality of plenums to the top surface of the polishing pad during the planarization process may be made based on the measurements. In addition, the measurements from the wafer during the planarization process may be used to determine a new desired flow rate and composition for subsequent wafers.

BRIEF DESCRIPTION OF THE DRAWINGS

The present invention will hereinafter be described in conjunction with the appended drawing figures, wherein like numerals denote like elements, and.

DETAILED DESCRIPTION OF EXEMPLARY EMBODIMENTS

An improved method and apparatus utilized in the polishing of semiconductor substrates and thin films formed thereon will now be described. In the following description, numerous specific details are set forth illustrating Applicant's best mode for practicing the present invention and enabling one of ordinary skill in the art to make and use the present invention. It will be obvious, however, to one skilled in the art that the present invention may be practiced without these specific details. In other instances, well-known machines and process steps have not been described in particular detail in order to avoid unnecessarily obscuring the present invention.

Figure 1:
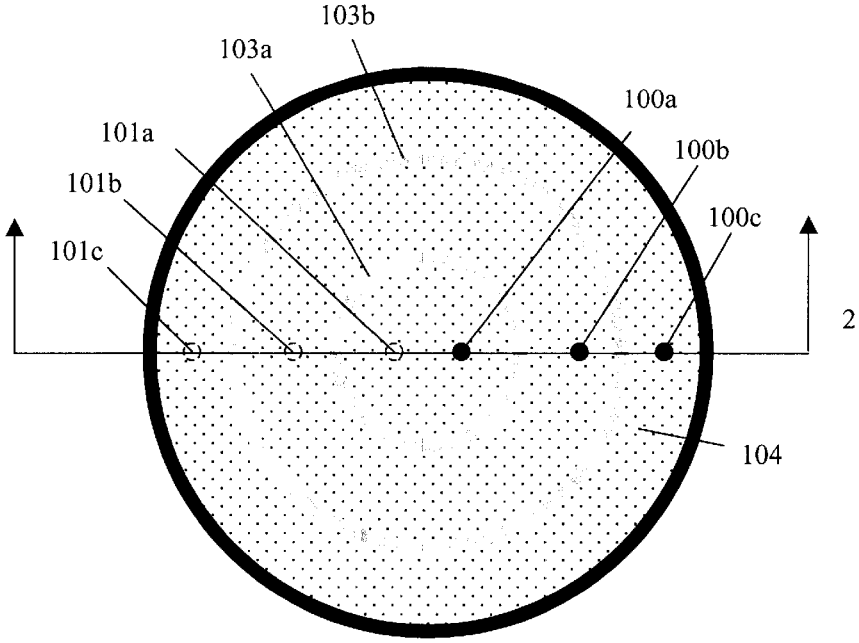
FIG. 1 is a top plan view of a planarization station in a chemical mechanical polishing tool.
Figure 2:
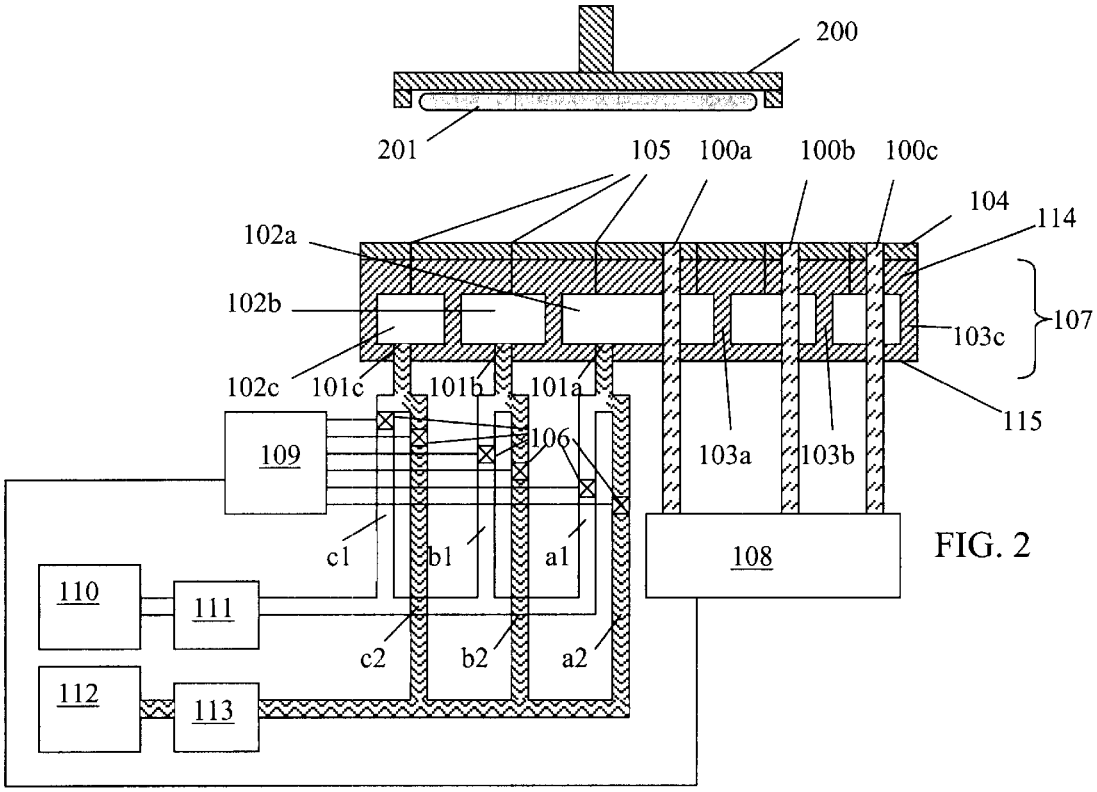
FIG. 2 is a cross section view of FIG. 1.

FIGS. 1 and 2 illustrate part of a planarization station in a chemical mechanical polishing tool according to the present invention. The invention may be used with a variety of polishing pads 104. The polishing pads 104 typically comprise a urethane based material. Examples of conventional polishing pads 104 that may be used with the invention are an IC1000 or an IC1000 supported by a Suba IV polishing pad. Both of these polishing pads 104 are manufactured and made commercially available by Rodel Inc. with offices in Phoenix, Ariz. The particular polishing pad 104 selected for use should be selected based on the material and condition of the front surface of the wafer 111 and the desired result.

Figure 3:
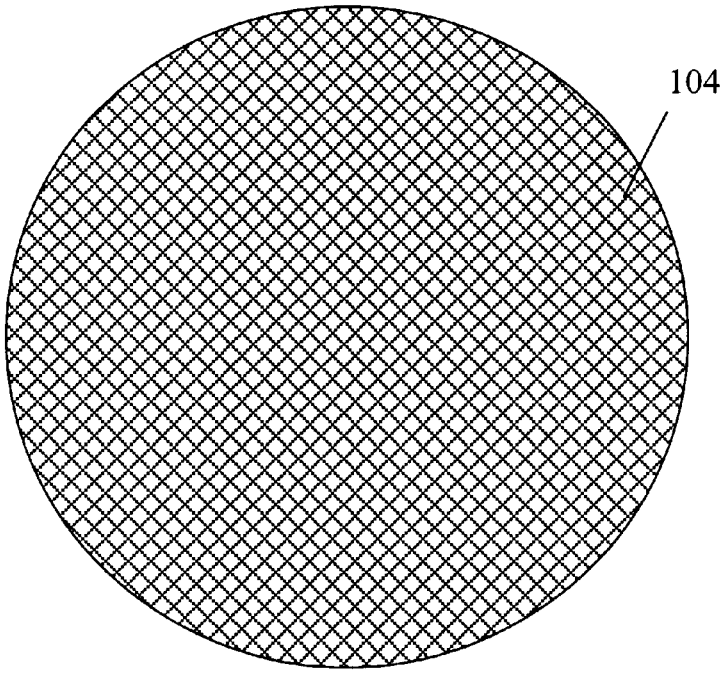
FIG. 3 is a top plan view of prior art polishing pad having X-Y grooves.
Figure 4:
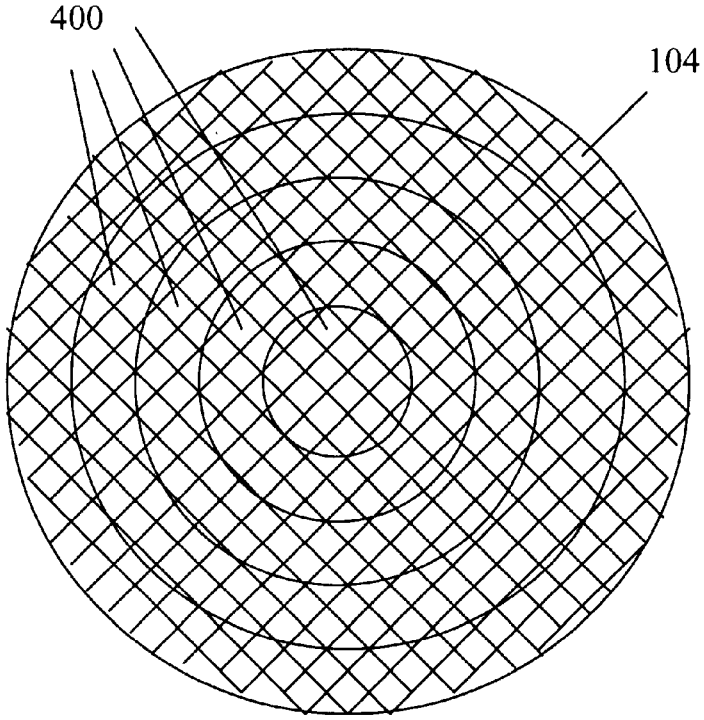
FIG. 4 is a top plan view of a polishing pad having reduced X-Y grooves in combination with circular grooves.

FIG. 3 shows a polishing pad 104 with a denser X-Y groove pattern than the polishing pad 104 shown in FIG. 4. The density of the X-Y groove pattern cut into the polishing pad 104 may be selected to control the rate the fluids are delivered and drained off the polishing pad 104. The higher the density and the larger the size of grooves the faster the drainage of fluids off the polishing pad 104. The density of X-Y grooves may also be individually customized for different areas across the surface of a single polishing pad 104. For example, if faster drainage of fluids is desired near the center of the polishing pad 104, a higher density, and/or larger size, of X-Y grooves may be cut into the center of the polishing pad 104. Circular grooves 400 may also be cut into the polishing pad to retain fluids around the circular grooves 400. By controlling the size and density of X-Y grooves and the positioning and number of circular grooves 400, additional control may be obtained over the flow of fluids on the top surface of the polishing pad 104.

As shown in FIG. 2, the polishing pad 104 may be supported by a rigid platen 107. The platen 107 preferably comprises a rigid noncorrosive material such as titanium, ceramic or stainless steel. The platen 107 includes a top surface 114, a bottom surface 115 and a plurality of circular walls 103*a*, 103*b*, and 103*c* that form a plurality of concentric plenums 102*a*, 102*b*, and 102*c*. The walls 103*a*, 103*b*, 103*c* may be an integral part of the top 114 or bottom 115 surface or some of the walls may be, for example, separate pieces comprising o-rings. If o-rings are used, grooves may be machined into the top 114 and bottom 115 surfaces to assist in holding the o-rings in place. The plenums 102*a*, 102*b*, and 102*c* are preferably fluid-tight to prevent fluid in one plenum from entering a neighboring plenum.

The top surface 114 of the platen 107 and polishing pad 104 may have holes 105 for delivering slurry or deionized water to the top surface of the polishing pad 104. The slurry may be used to place chemicals and/or abrasives at the wafer-polishing pad interface. The chemicals and/or abrasives are used to enhance the planarization process by, for example, increasing the removal rate or improving the uniformity of the surface of the wafer. The slurry and deionized water may also be used to flush away debris from the top surface of the polishing pad 104 to limit the loading of material in the polishing pad 104. Also, a fluid, such as deionized water, may be delivered through the top surface 114 and polishing pad 104 during the conditioning of the polishing pad 104 to assist in flushing the material loaded in the polishing pad 104 away.

Each plenum 102*a*, 102*b*, and 102*c* should have a corresponding fluid delivery source 101*a*, 101*b*, and 101*c*. The fluid delivery sources 101*a*, 101*b*, and 101*c* are illustrated along a single diameter of the bottom surface 115 to simplify the figures, but they may vary from these positions. A fluid delivery system typically comprising a tank 110, 112 filled with a desired fluid and a pump 111, 113 for transporting the fluid from the tank 110, 112 to the fluid delivery source 101*a*, 101*b*, and 101*c*. The fluid delivery sources 101*a*, 101*b*, and 101*c* may be used to communicate fluids to respective plenums 102*a*, 102*b*, and 102*c*. The flow rate of the fluids into each plenum 102*a*, 102*b*, and 102*c* may be adjusted by the pumps 111, 113, but is preferably controlled using one or more valves 106. The valves 106 may be any mechanical or electrical devices that are able to accurately control and regulate the flow rate of a fluid. The valves may be connected to, and controlled by, a computer 109. The computer 109, e.g. computer network, microcontroller, or other electronic control device, may be used to automate the chemical mechanical polishing tool and precisely control the valves 106. One valve 106 is preferably used for each fluid source a1, a2, b1, b2, c1, and c2 into each plenum 102*a*, 102*b*, and 102*c* as this allows each fluid source to be individually controlled. While FIG. 2 shows a two fluid system for each plenum, a single fluid system or more than two fluid system may also be used with a corresponding number of valves. The flow rate for each fluid delivery source is the sum of all flow rates from the connected fluid sources. For example, the flow rate for fluid delivery source 101*a* is the sum of the flow rates from fluid sources a1 and a2. Thus, the flow rate into each plenum 102*a*, 102*b*, and 102*c* may be controlled by controlling the flow rate for each valve 106 leading to that particular plenum.

The fluid composition that is delivered into each plenum 102*a*, 102*b*, and 102*c* may be individually controlled for each plenum 102*a*, 102*b*, and 102*b* by controlling the ratio of fluids through the valves 106. For example, adjusting the valves 106 to allow twice the flow of fluids from fluid source a2 as from fluid source al will produce a 2:1 concentration of fluids from fluid source a2 as from fluid source a1 in plenum 102*a*. Some of the factors to be considered in selecting a desired fluid composition include the type of slurries, the ratio of slurries to deionized water and oxidizer concentrations.

FIG. 2 shows one possible way of creating a point of use mixture for the fluids. The fluids from the fluid sources a1, a2, b1, b2, b3, and b4 do not mix until just prior to entering the plenums 102*a*, 102*b*, and 102*c*. To delay the mixture even further, each fluid may have its own fluid delivery source into each plenum, thereby allowing the fluids only to mix within the plenums. Mixing the fluids at the point of use is preferred as this prevents the fluids from undesirably interacting with each other.

The fluid flow rate and composition into each plenum 102*a*, 102*b*, or 102*c* are vital to the planarization process as they directly relate to the fluid flow rate and composition of the fluids onto the top surface of the polishing pad 104 above that plenum. In general, a faster flow rate with more aggressive undiluted slurries will increase the material removal rate from the front surface of the wafer. Altering the fluid flow rate and composition allows the material removal rate on the front surface of the wafer to be adjusted during the planarization process.

Metrology instruments 108 are known in the art for taking measurements of the front surface of a wafer 201 during the planarization process. These systems use a wide range of technologies, e.g. lasers or multifrequency optic systems, to take the measurements. The metrology instrument 108 may be used to measure film thicknesses, removal rate, uniformity or other characteristics of the wafer. This information may be used to determine if alterations to the planarization process should be performed. The metrology instrument is preferably a multiprobe endpoint detection systems. For example, a Sentinel, sold by SpeedFam-IPEC headquartered in Phoenix, Ariz. may be used. The results of the measurements are preferably communicated to the computer 109. The computer 109 may be used to determine if corrective action is needed to the planarization process and if corrective action is needed what action should be taken. Corrective action may comprise altering the fluid flow rate and/or composition of fluids directed through particular plenums 102*a*, 102*b*, and 102*c* to the top surface of the polishing pad 104.

Figure 5:
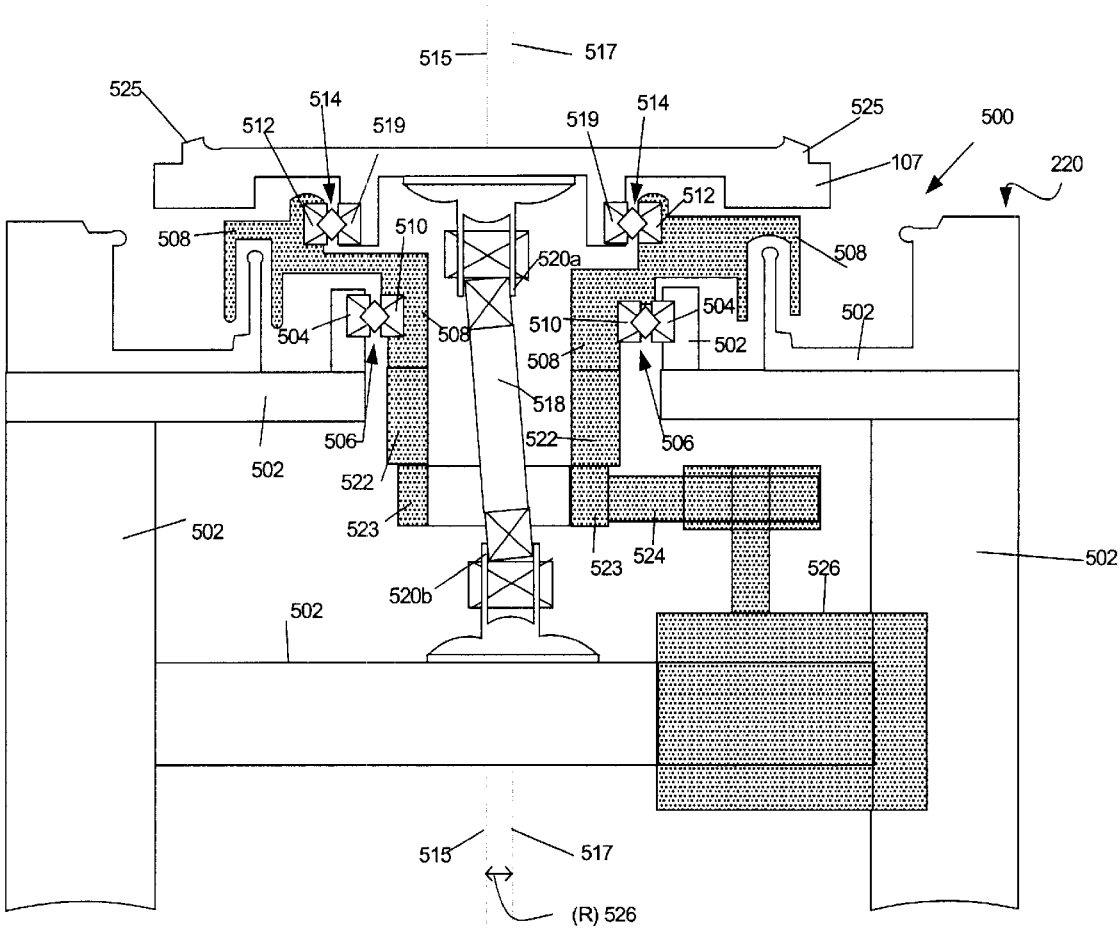
FIG. 5 is a cross section view of an apparatus for orbiting a polishing pad.

The polishing pad 104 is preferably orbited during the planarization process of the wafer 201 and oscillated clockwise and counter-clockwise. FIG. 5 is a cross-sectional view of an exemplary motion generator 500 that may be used to generate an orbital motion for the platen 107 and polishing pad 104. The motion generator 500 is generally disclosed in U.S. Pat. No. 5,554,064 Breivogel et al. and is hereby incorporated by reference. Supporting base 220 may have a rigid frame 502 that can be securely fixed to the ground. Stationary frame 502 is used to support and balance motion generator 500. The outside ring 504 of a lower bearing 506 is rigidly fixed by clamps to stationary frame 502. Stationary frame 502 prevents outside ring 504 of lower bearing 506 from rotating. Wave generator 508 formed of a circular, hollow rigid body, preferably made of stainless steal, is clamped to the inside ring 510 of lower bearing 506. Wave generator 508 is also clamped to outside ring 512 of an upper bearing 514. Waver generator 508 positions upper bearing 514 parallel to lower bearing 506. Wave generator 508 offsets the center axis 515 of upper bearing 514 from the center axis 517 of lower bearing 506. A circular platen 107, preferably made of aluminum, is symmetrically positioned and securely fastened to the inner ring 519 of upper bearing 514. A polishing pad or pad assembly can be securely fastened to ridge 525 formed around the outside edge of the upper surface of platen 107. A universal joint 518 having two pivot points 520*a* and 520*b* is securely fastened to stationary frame 502 and to the bottom surface of platen 107. The lower portion of wave generator 508 is rigidly connected to a hollow and cylindrical drive spool 522 that in turn is connected to a hollow and cylindrical drive pulley 523. Drive pulley 523 is coupled by a belt 524 to a motor 526. Motor 526 may be a variable speed, three phase, two horsepower AC motor.

The orbital motion of platen 107 is generated by spinning wave generator 508. Wave generator 508 is rotated by variable speed motor 526. As wave generator 508 rotates, the center axis 515 of upper bearing 514 orbits about the center axis 517 of lower bearing 506. The radius of the orbit of the upper bearing 517 is equal to the offset (R) 526 between the center axis 515 of upper bearing 514 and the center axis 517 of the lower bearing 506. Upper bearing 514 orbits about the center axis 517 of lower bearing 506 at a rate equal to the rotation of wave generator 508. It is to be noted that the outer ring 512 of upper bearing 514 not only orbits but also rotates (spins) as wave generator 508 rotates. The function of universal joint 518 is to prevent torque from rotating or spinning platen 107. The dual pivot points 520*a* and 520*b* of universal joint 518 allow the platen 107 to move in all directions except a rotational direction. By connecting platen 107 to the inner ring 519 of upper bearing 514 and by connecting universal joint 518 to platen 107 and stationary frame 502 the rotational movement of inner ring 519 and platen 107 is prevented and platen 107 only orbits as desired. The orbit rate of platen 107 is equal to the rotation rate of wave generator 508 and the orbit radius of platen 107 is equal to the offset of the center 515 of upper bearing 514 from the center 517 of lower bearing 506.

It is to be appreciated that a variety of other well-known means may be employed to facilitate the orbital motion of the platen 107. While a particular method for producing an orbital motion has been given in detail, the present invention may be practiced using a variety of techniques for orbiting the platen 107. The platen 107 is preferably orbited with a radius between about 20 mm and 5 mm. In should also be noted that other embodiments of the invention may be practiced with rotational or linear motions for the polishing pads.

Figure 6:
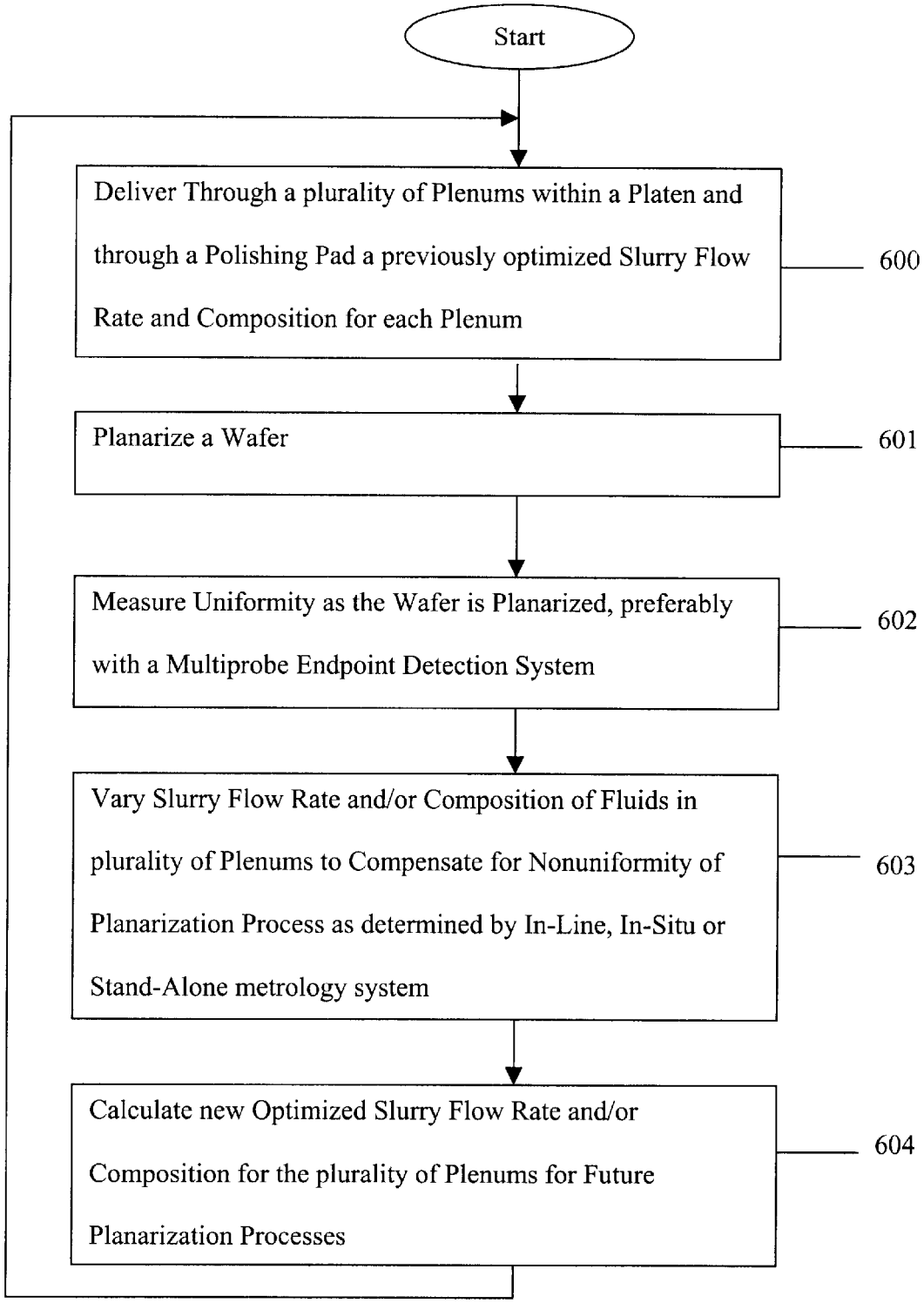
FIG. 6 is a flow chart of an exemplary method of practicing the present invention.

Referring to FIGS. 2 and 6, in operation valves 106 may be individually adjusted by a computer 109 to allow a desired flow rate and composition of fluids into each plenum 102*a*, 102*b*, and 102*c*. The fluids within each plenum 102*a*, 102*b*, and 102*c* may travel through small holes in the top surface 114 of the platen 107 and polishing pad 104 to reach the top surface of the polishing pad 104. (Step 600) The polishing pad 104 may be orbited as a wafer 201 in a carrier 200 is pressed against the polishing pad 104. The fluids introduced through the plenums 102*a*, 102*b*, and 102*c* enhance the planarization process by stimulating a chemical reaction that is combined with the mechanical process of the wafer 201 rubbing against the polishing pad 104. The chemical reaction and mechanical action serve to remove material from the front surface of the wafer and to planarize the wafer. (Step 601)

While the wafer 201 is being planarized, the topography and uniformity of the wafer 201 may be measured. (Step 602) The preferred method is to use a multiprobe endpoint detection system 108. In the most preferred embodiment, the multiprobe endpoint detection system 108 has a corresponding number and location of probes 100*a*, 100*b*, and 100*c* as the platen has number and location of plenums 102*a*, 102*b*, and 102*c*. This allows necessary adjustments to the fluid flow rate and composition of the fluids to be more easily calculated. Applicant has noticed that the removal rate during the planarization process may be altered for particular areas on the front surface of a wafer 201. This may be accomplished by adjusting the flow rate and/or composition of fluids delivered through the plenums 102*a*, 102*b*, and 102*c* to the wafer-polishing pad interface. The measured topography by the metrology instrument 108 of the front surface of the wafer 201 may be analyzed and areas that need an increase or decrease in removal rate may be determined.

An increase in fluid flow rate and/or more aggressive polishing composition may generally be used to increase the removal rate of material in areas that are polishing too slowly. Likewise, a decrease in fluid flow rate and/or less aggressive polishing compositions may generally be used to decrease the removal rate of material in areas that are polishing too quickly. The amount of adjustment necessary for the fluid flow rate and/or composition of fluids within each of the plenums 102*a*, 102*b*, and 102*c* will vary depending on the particular workpiece being planarized as well as other polishing parameters. The effect of varying the flow rate and/or composition of the fluids for each plenum 102*a*, 102*b*, and 102*c* will generally need to be found empirically for each workpiece and planarization process. The fluid's flow rate and/or composition may then be adjusted by the computer 109 altering the valves 106 in a manner that will result in a more uniform planarization process. Specifically, the removal rate in areas that are polishing too slowly may be increased and/or the removal rate in areas that are polishing too quickly may be decreased. (Step 603)

After the wafer 201 has been planarized, a new fluid flow rate and composition of fluids may be calculated to improve the planarization process for the next wafer (run-to-run control). (Step 604) With this method, fewer changes in the fluid flow rate and composition of fluids will be needed during the planarization process resulting in a more stable and repeatable process.

While the invention has been described with regard to specific embodiments, those skilled in the art will recognize that changes can be made in form and detail without departing from the spirit and scope of the invention.

We claim:

1. An apparatus for planarizing a workpiece comprising:

a) a platen, wherein the platen comprises:

a bottom surface, wherein the bottom surface has a plurality of holes;

a top surface, wherein the top surface has a plurality of holes;

a plurality of circular walls extending from the bottom surface to the top surface, wherein the bottom surface, the top surface and the plurality of circular walls define a plurality of plenums within the platen;

b) a plurality of fluid delivery systems, wherein at least one fluid delivery system is in fluid communication with at least one of the holes in the bottom surface of the platen located beneath each plenum.

2. The apparatus according to claim 1 wherein at least one of the circular walls is an integral part of the bottom surface of the platen.

3. The apparatus according to claim 1 wherein at least one of the circular walls is an integral part of the top surface of the platen.

4. The apparatus according to claim 1 wherein at least one of the circular walls comprises an o-ring.

5. The apparatus according to claim 1 further comprising:

c) a polishing pad supported by the top surface of the platen.

6. The apparatus according to claim 5 wherein the polishing pad has a plurality of holes that align with at least some of the holes in the top surface of the platen.

7. The apparatus according to claim 5 further comprising:

d) a metrology instrument having at least one probe for measuring a front surface of the workpiece.

8. The apparatus according to claim 7 wherein the metrology instrument comprises a multiprobe endpoint detection system.

9. The apparatus according to claim 7 wherein at least one fluid delivery system comprises:

a tank;

a pump for communicating fluids from the tank to the plenums;

a valve for regulating the flow of fluids from the tank to the plenums; and a computer in electrical communication with the valve.

10. The apparatus according to claim 7 further comprising:

c) an orbital motion generator connected to the bottom surface of the platen.

11. An apparatus for planarazing a workpiece comprising:

a) a platen, wherein the platen comprises:

a bottom surface, wherein the bottom surface has a plurality of holes;

a top surface, wherein the top surface has a plurality of holes;

a plurality of circular walls extending from the bottom surface to the top surface, wherein the bottom surface, the top surface and the plurality of circular walls define a plurality of plenums within the platen;

b) a plurality of fluid delivery systems, wherein at least one fluid delivery system is in fluid communication with at least one of the holes in the bottom surface of the platen located beneath each plenum;

c) a polishing pad supported by the top surface of the platen;

d) a multiprobe end point detection system for measuring a front surface of the workpiece, wherein the multiprobe endpoint detection system has at least one probe mounted in every plenum.

12. A method for planarizing a wafer comprising the steps of:

a) delivering a desired flow rate and composition of fluids from a plurality of concentric plenums within a platen to a top surface of a polishing pad;

b) moving the polishing pad in relation to a front surface of a wafer;

c) pressing the front surface of the wafer against the top surface of the polishing pad;

d) measuring the front surface of the wafer; and e) changing the flow rate or composition of fluids from one or more of the plurality of plenums to the top surface of the polishing pad based on the measurements taken from the front surface of the wafer.

13. The method of claim 12 wherein the polishing pad is orbited in relation to the front surface of the wafer.

14. The method of claim 13 wherein the measuring the front surface of the wafer is done with a multiprobe endpoint detection system.

15. The method of claim 13 further comprising the step of:

f) determining a new desired flow rate and composition of fluids for a subsequent wafer based on measuring the wafer during the planarization process.

16. A method for planarazing a wafer comprising the steps of:

a) delivering a desired flow rate and composition of fluids from a plurality of concentric plenums within a platen to a top surface of a polishing pad;

b) orbiting said polishing pad in relation to the front surface of the wafer;

c) pressing the front surface of the wafer against the top surface of the polishing pad;

d) measuring the front surface of the wafer within multiprobe endpoint direction system, wherein the multiprobe endpoint detection system has at least one probe located above each plenum in the platen; and e) changing the flow rate or composition of fluids from one or more of the plurality of plenums to the top surface of the polishing pad based on the measurements taken from the front surface of the wafer.

* * * * *